United States Patent [19]

Garavuso

[11] Patent Number: 4,930,766

[45] Date of Patent: Jun. 5, 1990

[54] PNEUMATIC COMPILING APPARATUS

[75] Inventor: Gerald M. Garavuso, Macedon, N.Y.

[73] Assignee: Xerox Corporation, Stamford, Conn.

[21] Appl. No.: 288,492

[22] Filed: Dec. 22, 1988

[51] Int. Cl.[5] ..... B65H 31/26

[52] U.S. Cl. ..... 271/220; 198/456; 271/197; 271/236

[58] Field of Search ..... 271/220, 221, 197, 198, 271/227, 236, 251; 198/456

[56] References Cited

U.S. PATENT DOCUMENTS

| | | | |
|---|---|---|---|
| 3,900,192 | 8/1975 | Gibson | 271/220 |
| 4,049,256 | 9/1977 | Church et al. | 271/251 |
| 4,157,177 | 6/1979 | Strecker | 271/197 |
| 4,248,413 | 2/1981 | Fox | 271/236 |
| 4,483,530 | 11/1984 | Spencer et al. | 271/236 |
| 4,627,608 | 12/1986 | Harms | 271/197 |

*Primary Examiner*—H. Grant Skaggs

*Attorney, Agent, or Firm*—William A. Henry, II

[57] ABSTRACT

A dual vacuum belt transport system for compiling copy sheet sets in a compiling tray includes a first vacuum belt that picks up a copy sheet and moves it to a forward registration wall for front edge alignment, and releases it. A second vacuum belt then picks up the copy sheet and moves it to a side registration wall to complete the compiling sequence. Each vacuum belt is angled with respect to a vertical plane in order to drive each copy sheet into a corner formed by the intersection of the forward and side registration walls.

13 Claims, 3 Drawing Sheets

PNEUMATIC COMPILING APPARATUS

The present invention relates generally to an electrophotographic printing machine that employs a finishing apparatus, and more particularly, concerns pneumatic compiling system within the finishing apparatus, In the field of on-line finishing of copy sheets attempts in the past have been made to fill the need for a system that will compile copy sheets within an output tray of a finisher without damaging the copy sheets or causing set disturbance in the process, e.g., by using angled paddle wheels or side tampers that offset sheet sets. However, experience has shown that these methods of handling copy sheets within a finisher apparatus have not been entirely satisfactory when used with printing machines that produce copy sheet sets for finishing at high rates of productivity.

Accordingly, disclosed in accordance with the present invention is an apparatus for compiling copy sheet sets within a finisher by the use of a dual vacuum belt transport system. The belts can be running sumultaneously or sequenced, as desired. One belt picks up a sheet as it leaves a source and carries it to a forward registration gate wall of the finisher for front alignment, and release it. The second belt then picks up the sheet and moves it to a side registration wall to complete compiling. The sequenced or continuously running vacuum belts are lightly driven to avoid sheet damage. A range of vacuum pressure is available for tuning as required for various sheet weights.

While the present invention will hereinafter be described in connection with preferred embodiments thereof, it will be understood that it is not intended to limit the invention to those embodiments. On the contrary, it is intended to cover all alternatives, modifications, and equivalents that may be included within the spirit of the invention as defined by the appended claims.

For a general understanding of the features of the present invention, reference is made to the drawings. In the drawings, like reference numerals have been used throughout to designate identical elements.

For a better understanding of the invention, reference is made to the following drawings and description.

Figure 1:
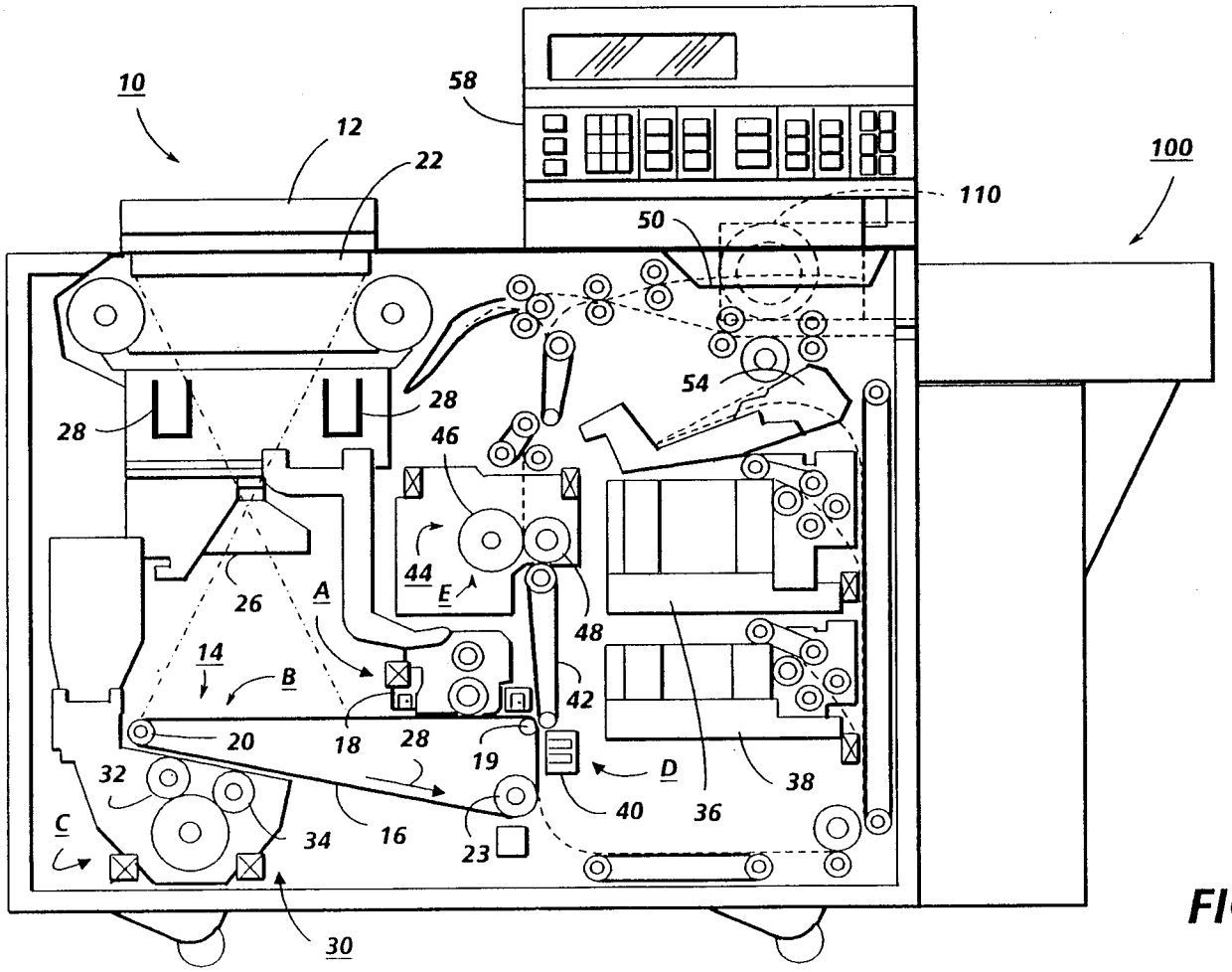
FIG. 1 is a schematic showing an electrophotographic machine feeding sheets to the improved finishing apparatus of the present invention. However, it will become apparent from the following discussion that the present finisher could be used with any sheet feeding machine, and is not limited to the embodiment shown herein.

Referring now particulary to FIG. 1, there is illustrated a printing machine 10 that includes conventional controller 58 and a recirculating document handling system 12 for advancing successive original documents onto the platen 22 of the processing module 14. Inasmuch as the art of electrophotographic printing is well known, the operation of the various processing stations employed in processing module 14 will be described briefly.

Processing module 14 employs a belt 16 having a photoconductive surface disposed on a conductive subtrate. Preferably the photoconductive surface is made from a selenium alloy with the conductive substrate being preferably made from an aluminum alloy which is electrically grounded. Belt 16 advances portions of the photoconductive surface sequentially through the various processing stations disposed about the path of movement thereof. Belt 16 is entrained about stripping roller 19, tensioning roller 20 and drive roller 23. Drive roller 23 is coupled to a suitable motor so as to rotate and advance belt 16.

Initially, a portion of belt 16 passes through charging station A. At charging ststion A, a corona generating device 18 charges the photoconductive surface of belt 16 to a relatively high, substantially uniform potential.

After the photoconductive surface of belt 16 is charged, the charged portion thereof is advanced through exposure station B. At exposure station B, an original document is advanced by the recirculating document handling system 12 to a transparent platen 22. Lamps 28 flash light rays onto the original document. The light rays reflected from the original document are transmitted through lens 26 forming a light image thereof, Lens 26 focuses the light image onto the charged portions of the photoconductive surface to selectively dissipate the charge thereon. This records an electrostatic image on the photoconductive surface of belt 16 which corresponds to the informational areas contained within the original document.

Thereafter, belt 16 advances the electrostatic latent image recorded of the photoconductive surface in the direction of arrow 28 to development station C. At development station C, a magnetic brush development system, indicated generally by the reference numeral 30, advances developer material into contact with the latent image. Preferably, magnetic brush development system 30 includes two magnetic brush developer rollers 32 and 34. Each roller advances developer material into contact with the latent image. These rollers form a brush of carrier granules and toner particles extending outwardly therefrom. The latent image attracts the toner particles from the carrier granules forming a toner powder image on the photoconductive surface of belt 16.

After the electrostatic latent image is developed, belt 16 advances the toner powder image to transfer station D. A sheet of support material is advanced to transfer station D from either copy sheet stack supporting apparatus 36 or 38. Transfer station D includes a corona generating device 40 which sprays ions onto the backside of the copy sheet. This attracts the toner powder image from the photoconductive surface to the copy sheet. After transfer, the copy sheet moves onto conveyor 42 which advances the sheet to fusing station E.

Fusing station E includes a fuser assembly, indicated generally by the reference numeral 44, which permanently affixes the transferred powder image to the copy sheet. Preferably, fuser assembly 44 comprises a heated fuser roller 46 and a back-up roller 48. The copy sheet passes between the fuser roller and back-up roller with the toner powder image contacting the fuser roller. In this manner, the toner powder image is permanently affixed to the copy sheet. After fusing, the copy sheet is either advanced to output tray 50, returned to duplex tray 54 for subsequent recycling so as to enable a toner powder image to be transferred to the other side thereof, or if compiling is required, directed into finisher 100. The detailed structure of finisher 100 will be described hereinafter with reference to FIGS. 2–4.

Figure 2:
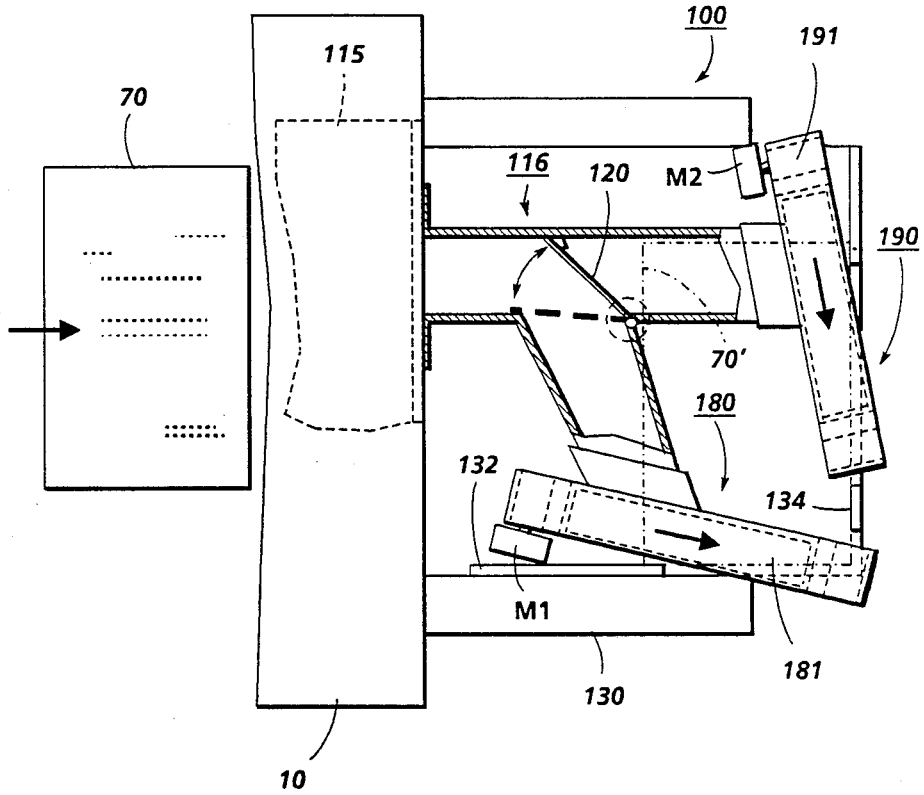
FIG. 2 is a partial fragmentary plan view of a finisher embodiment of the present invention employed in the electrophotographic machine of FIG. 1.
Figure 3:
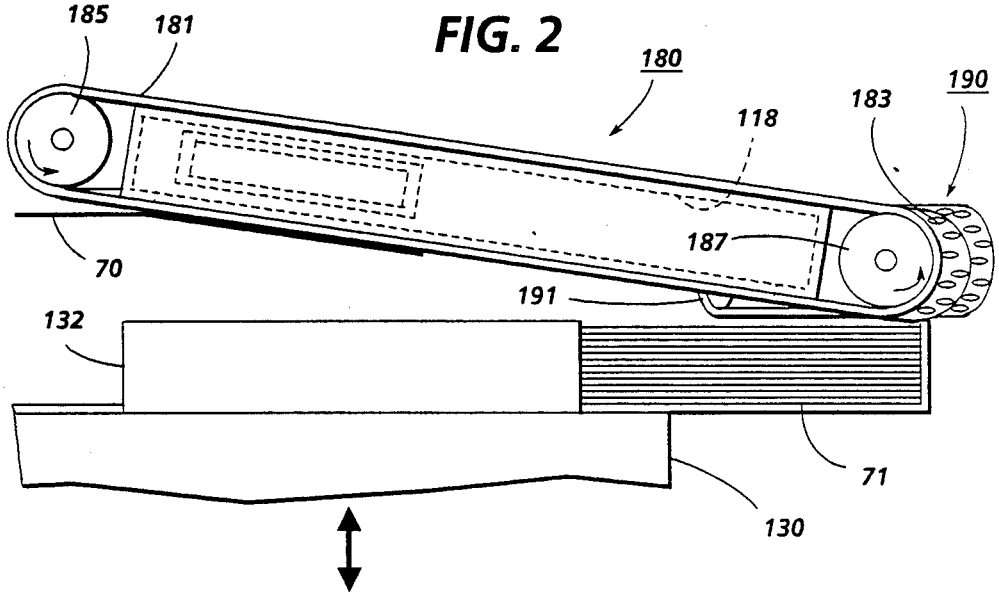
FIG. 3 is a partial side view of the dual vacuum belt transport system of the present invention.

Referring now to FIG. 2, there is shown a partial fragmentary plan view illustrating a finisher embodiment 100 of the present invention that employs a dual vacuum belt transport system. A copy sheet 70 is directed toward finisher 100 past chute 115 that is connected to vacuum source 110 and manifold 116 and into finisher 100. Just before the sheet reaches tray 130 motor M1 connected to drive wheel 185 is actuated to drive belt 181 of vacuum transport 180. Vacuum pressure through manifold 116 and plenum or chamber 118 is applied through perforations 183 in belt 181 and draws sheet 70 thereto. Belt 181 is entrained around drive roller 185 and idler roller 187 and is driven in the direction of the arrows on each roller. Each sheet 70 is attracted to belt 181 due to the vacumm applied to the belt from plenum 118 as shown in FIG. 3. It is possible for a number of sheets to be on belt 181 at the same time.

Figure 4:
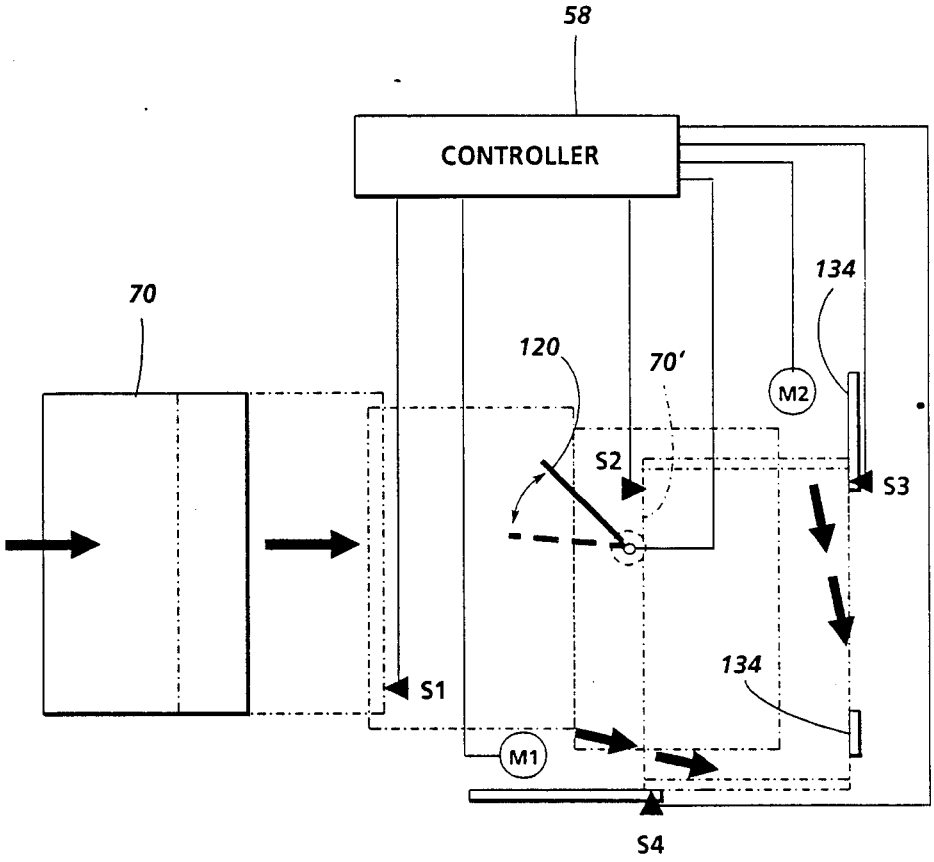
FIG. 4 is a diagrammatic plan view of the apparatus of FIG. 3.

A sheet 70 as shown in FIG. 4 en route to tray 130 and driven by the sheet transport of printing machine 10 passes over sensor S1 and the lead edge of the sheet is sensed sending a signal to controller 58 which in turn actuates motor M1 and drives vacuum transport 180. Normal force is established between the sheet and the perforated Mylar belt 181 as shown in FIG. 3 and the sheet is transported as shown in dotted lines in FIG. 4 to registration end wall 134. Trail edge sensor "S2 senses the trail edge of sheet 70" and sends a signal to controller 58 which in turn causes deflector vanes 120 to move to the dotted line position of FIG. 4. This closes off the vacuum to belt 181 and transfers it to vacuum transport 190 and belt 191. Virtually simultaneously, motor M2 is actuated by sensor S3 to drive belt 190. Belt 191 registers sheet 70 against side registration wall 132 and into the corner formed by the intersection of end wall 134 and side wall 132. A sensor S4 through controller 58 serves to stop motor M2 and reset deflector vane 120 to its solid line position. This in effect resets the system for handling of the next sheet 70 that is transported into the finisher.

Once sensor S1 actuates motor M1 through controller 58, the motor is ON continuously for the particular copy set that is to be finished. Motor M2 while described as being turned ON by sensor S3 and OFF by sensor S4 could be left ON continuously, if desired. This alternative approach would eliminate sensor S3 as well as the use of sensor S4 for turning motor M2 OFF. Another alternative contemplated by the present invention is to include continuously running belts 181 and 191 without valving the vacuum source. Also, if one desired, belts 181 and 191 could be ON continuously with deflector vane 120 gradually moving to shift the preponderance of the vacuum pressure from belt 181 to belt 191.

It should be understood that belt 190 and its concomitant structure could be eliminated if desired with only vacuum transport 180 being used to register copy sheets in compiling tray 130. Perforated Mylar belt 181 would be wrapped around vacuum plenum 118 and located above, or possibly resting on the compiling tray. If the belt is to rest on the compiling tray, it would be counterbalanced such that the belt would be allowed to float and thereby compensate for stack height changes. A copy sheet exiting printer 10 approaches the continuously moving belt 181 from below and is attached to the belt due to the pressure differential of the vacuum and driven to the corner of the compiler tray. When the copy sheet is registered its motion is halted by a gate through which the belt passes. The vacuum can be valved OFF once registration is achieved to allow entry of the next sheet. If the belt is in fact resting on the stack lead edge (allowing the next sheet to be inserted above it) sufficient support would have to be available to suppress any buckle.

While the invention has been particulary shown and described with reference to preferred embodiments thereof, it will be understood by those skilled in the art that various changes in form and details may be made therein without departing from the spirit and scope of the invention.

What is claimed is:

1. A sheet stacking apparatus having a tray for receiving sheets for stacking, comprising: registration wall means; and means for stacking sheets in the tray, said means for stacking sheets in the tray including a dual vacuum belt transport system having a first vacuum belt for driving sheets in a first direction into said registration wall means and a second vacuum belt for driving individual sheets transverse to said first direction so as to side register the sheets.

2. The sheet stacking apparatus of claim 1, wherein at least one of the vacuum belts of said dual vacuum belt system is running continuously during a sheet stacking operation.

3. The sheet stacking apparatus of claim 2, wherein said vacuum belts are angled with respect to a vertical plane.

4. The sheet stacking apparatus of claim 3, wherein at least one of said vacuum belts forms an acute angle with respect to a horizontal plane.

5. The sheet stacking apparatus of claim 4, including deflector means for directing vacuum pressure to either of said first or second vacuum belts as required.

6. A dual vacuum belt transport system for compiling copy sheet sets in a finisher, comprising:

a compiling tray;

a first vacuum belt that picks up a copy sheet and carries it to a forward registration wall of said compiling tray for front edge alignment and then releases it; and a second vacuum belt that picks up the copy sheet and moves it to a side registration wall of said compiling tray to complete the compiling operation.

7. The sheet stacking apparatus of cliam 6, wherein at least one of the vacuum belts of said dual vacuum belt system is running continuously during a sheet stacking operaton.

8. The sheet stacking apparatus of claim 7, wherein said vacuum belts are angled with respect to a vertical plane.

9. The sheet stacking apparatus of claim 8, wherein at least one of said vacuum belts forms an acute angle with respect to a horizontal plane.

10. The sheet stacking apparatus of claim 6, including deflector means for directing vacuum pressure to either of said first or second vacuum belts as required.

11. The sheet stacking apparatus of claim 10, wherein said first and second vacuum belts extend through a cut-out portion of said forward and side registration walls.

12. A sheet compiling apparatus having a tray for receiving sheets for compiling, comprising: registration wall means; and means for compiling sheets in the tray, said means for compiling sheets in the tray including a dual vacuum belt transport system having a first vacuum belt for driving sheets in a first direction toward said registration wall means and a second vacuum belt for driving the transverse to said first direction so as to side register the sheets, and wherein said first and second vacuum belts are running simultaneously.

13. The sheet compiling apparatus of claim 12, wherein at least one of said vacuum belts transports a plurality of sheets attracted thereto simultaneously.

* * * * *